United States Patent [19]

Jürissen et al.

[11] Patent Number: 4,964,884

[45] Date of Patent: Oct. 23, 1990

[54] FLEXIBLE GRINDING TOOL AND PROCESS FOR PRODUCING IT

[75] Inventors: Günter Jürissen, Schenefeld; Angelika Eichler, Pinneberg, both of Fed. Rep. of Germany

[73] Assignee: Inorddeutsche Industrie Christiansen & Co.(GmbH & Co.), Fed. Rep. of Germany

[21] Appl. No.: 323,315

[22] Filed: Mar. 14, 1989

[30] Foreign Application Priority Data

Mar. 14, 1988 [DE] Fed. Rep. of Germany ..... 8803413

[51] Int. Cl.[5] ..... B24B 1/00

[52] U.S. Cl. ..... 51/295; 51/293; 51/296; 51/298; 252/382

[58] Field of Search ..... 51/293, 295, 296, 298; 252/382

[56] References Cited

U.S. PATENT DOCUMENTS

| | | | |
|---|---|---|---|
| 3,166,388 | 1/1965 | Riegger et al. | 51/298 |
| 4,038,047 | 7/1977 | Haywood | 51/295 |
| 4,255,164 | 3/1981 | Butzke et al. | 51/295 |
| 4,543,106 | 9/1985 | Parekh | 51/296 |
| 4,629,473 | 12/1986 | Ruid et al. | 51/295 |

*Primary Examiner*—William R. Dixon, Jr.
*Assistant Examiner*—Willie Thompson
*Attorney, Agent, or Firm*—Chilton, Alix & Van Kirk

[57] ABSTRACT

The interspace-filling finish (10, 15) of the textile backing of a flexible grinding tool has a foam structure, thereby achieving better filling properties, while at the same time ensuring good fiber bonding.

22 Claims, 1 Drawing Sheet

FLEXIBLE GRINDING TOOL AND PROCESS FOR PRODUCING IT

The invention relates to a flexible grinding tool with a flexible backing which contains a fibrous structure and the empty spaces of which are at least partially filled with a finish solidified from the flowable state. The invention relates furthermore to a process for producing such a grinding tool.

Textile materials used for making the flexible backing of grinding tools, for example fabrics, stitch-bonded cloths and nonwovens, need to be reinforced before the abrasive grain is applied. The finish serves for this reinforcement. By a finish is meant a mass which is introduced in the flowable state into the textile material and which solidifies therein and thereby connects the fibers of the textile structure to one another and reinforces them. It has the further purpose of filling the fiber and thread interspaces of the backing at least in the region near the surface, in order thereby to protect it against the penetration of the grain binder which is undesirable within the base because of its embrittling influence. It also protects against the penetration of other undesirable substances, especially grinding auxiliaries, such as water, grinding emulsion or oil. Since the finish contributes to transmitting the forces which act between the abrasive grain and the backing and within the backing, it must be anchored securely to and between the fibers or fiber strands forming the backing. This is the better achieved, the lower the viscosity in the application state. However, in another respect a low viscosity is undesirable, because it generally means the presence of considerable quantities of solvents or dispersion media which increase the outlay in terms of drying (energy requirement, length of dryer). Also, the applicable amount of substance can be limited thereby. Finally, too great depths of penetration caused by a low viscosity can entail adverse changes in the properties of the backing, for example an embrittlement of the fibers in finishes based on phenol resin.

It is known (EP-A-104,776) to use as a filling finish a synthetic resin which contains a high percentage of fillers. However, synthetic resins with a high filler content have the disadvantage of low elasticity. Moreover, in the application state, the viscosity is increased and consequently the anchorability reduced.

An object on which the invention is based is to provide a grinding tool of the type mentioned in the introduction, of which the finish, while ensuring a good bonding to the backing, has good filling properties and the capacity for forming a sufficiently thick layer. A further object on which the invention is based is to provide a process for introducing such a finish into the backing.

In the solution according to the invention, the finish is foamed.

The invention is based on the surprising finding that the use of foam reduces the problems of consistency explained above, because it has as it were two consistencies. Even a foam prepared from a relatively low-viscosity substance has considerable dimensional stability which allows a sufficiently thick layer to be applied, the mass of the solids remaining after hardening and that of the solvent or dispersion medium to be expelled during the drying operation or of the water occurring as a result of chemical conversion being low. In contrast, the capacity of the foam to anchor itself to the surface of the backing on the fibers and in the fiber interspaces is influenced by the dehydration capacity and viscosity of the liquid on which the foam is based, and this viscosity can be selected comparatively low irrespective of the dimensional stability of the foam as a whole. The capacity of the liquid forming the foam to penetrate into the fiber interspaces and anchor itself there is not reduced by the foam structure, especially since it has been shown that, in the lower region adjacent to the textile surface, the foam tends to increase its density because the larger bubbles migrate away from the backing, especially when application takes place from above onto the horizontal or inclined sheet. In many cases, therefore, the finish according to the invention is distinguished in that its density is higher at the interface with the backing than at a distance from this. At the same time, however, the mass of liquid freely available in the boundary region with a textile backing is limited. This limits the amount of liquid which can migrate from the foam-filled larger pores and thread interspaces into the small fiber interspaces as a result of capillary forces. This is desirable because the aim is only to fill the larger pores and thread interspaces and anchor the foamed finish firmly to the fibers limiting these pores and interspaces, whereas the small capillary interspaces, especially in the core of the threads, will remain free.

An essential advantage of the invention is that surface depressions in the backing, for example those between fiber strands of textile backings, can be filled substantially with the foam finish. This applies especially to the interspaces between adjacent threads or fiber strands of stitch-bonded fabrics. A relatively smooth plane surface can be achieved thereby, even when there is considerable unevenness of the backing.

Furthermore, the rear side formed by fiber strands and an intermediate foam filling affords the advantage that the fiber strands, as ribs, can perform the function of most of the force transmission, while the intermediate foam filling is relieved of the forces. This is achieved because the foam filling is arranged only between the fiber strands and does not exceed their height. However, the foam filling can also contribute to the force transmission to the extent desired, if the height of the rear foam finish exceeds that of the fiber strands in the non-loaded state, without any appreciable layer thickness on the fiber strands, the foam selected being of such flexible consistency that, under the operational forces (mainly the pressure of the drive rollers and/or the pressure of a pressure bar or pressure shoe used for generating the grinding pressure), it is compressed as much as the height of the fiber strands allows. Only a force as high as is necessary for this compression is then transmitted in the region of the foam finish. In this embodiment, a substantial layer thickness on the fiber strands is avoided, so that high forces can be transmitted there, irrespective of the possibly limited strength of the foam finish.

In another embodiment, the foam finish can form a layer which covers the rear side (including the fiber strands) completely and essentially. This has the advantage of a high smoothness of the rear side, such as it has hitherto been impossible to obtain by means of conventional processes with a single application, especially in respect of cost-effective stitch-bonded fabrics with a non-uniform or uneven surface or a small fabric density. The abrasive effect exhibited by many conventional backings on the sliding coverings of pressure bars or pressure shoes of grinding machines can be prevented thereby.

Moreover, surprisingly, a pronounced resistance to the fulling, tensile and shearing stresses occurring during the grinding operation was found, so that, even towards the end of a fatigue test, when there was an unchanged uniform smooth rear side, a correspondingly uniform grinding pattern was also obtained on the workpiece surface. Moreover, in comparison with belts finished in the conventional way, an especially quiet low-vibration running behavior and an improved force transmission between the drive elements and the belt rear side was found.

For producing a rear covering layer and for filling rear depressions, it is expedient to select a foam of medium softness, in particular a foam in which the pressure required for compression to half the thickness is at least 700 kPa, preferably at least 1200 kPa, and at most 2500 kPa.

The depression filling, in which the higher fiber strands are scarcely covered by a foam layer, if at all, is appropriately scraped on, so that the surplus located above the highest elevations of the backing can be removed and these highest elevations themselves have remained essentially coating-free. There thus forms an interspace filling, the surface of which approaches the height of the fiber strands at the edges of the respective interspaces. At the same time, the height of the interspace filling can be lower than the height of the fiber strands if a loss of volume occurs after the scraping-on operation; it can also be of the same height; however, it can even be rounded up higher if the foam follows up after the scraping on.

If there is a continuous foam layer on the rear side, it can be advantageous to calender this after the formation of the foam, that is to say guide it by means of pairs of pressing rollers. This is appropriately carried out with the simultaneous supply of heat. The density of the layer thereby becomes greater near its free surface than in its deeper regions. This is because the heat effect of the heated calendering roller is more intensive near the surface. As a result of the higher density of the foam layer near the surface, the calendered foam layer is distinguished by a higher capacity for mechanical resistance.

If the strength of the foam layer cannot withstand the attack of external forces, for example the frictional force of a drive roller or the force of a surface acting on the rear side of the grinding belt and generating the grinding pressure, it can be expedient, furthermore, to cover the foam finish on the surface of the backing with an additional layer of higher strength which can be non-foamed and which can consist of the same or another material, especially synthetic resin.

In the ready-to-use state, the density of the foam finish is preferably on average 0.5 to 0.9 g/cm$^3$, preferably approximately 0.7 g/cm$^3$.

Even though the use of the foam finish on the rear side of the grinding belt affords special advantages, there is still also the possibility of using it on the grain side, particularly for the filling of depressions and fiber-strand interspaces of the backing surface on the grain side, to form a smooth surface of the finished backing for receiving the layer of abrasive grains. A very firm foam absorbing the grinding pressure in a virtually incompressible way should be chosen for the purpose. By this is meant that the flexibility of the foam-filled regions is so low that it has no effect on the grinding result. This condition is satisfied at least when the compression of the foam-filled regions of the ready-to-use grinding belt under the grinding pressure is less than one third of the mean abrasive-grain dimension.

It is not necessary for the finish foamed according to the invention to be the only finish of the backing. On the contrary, it is possible to apply, for example before this, a primary finish which lies perceptibly or preferably imperceptibly between the foam finish and the fibers forming the backing. Furthermore, the invention does not exclude the possibility that the foam finish according to the invention is followed by a further finish with a foamed or non-foamed material, for example to form a hard or tough covering surface before the layer of abrasive grains is applied.

The advantage of the foam finish, namely that surface depressions of the backing are filled, relates not only to surface depressions closed in terms of their depth, but also to those which are open and which pass through from one side of the backing to the other and are closed only by the foam finish.

Although it is known (U.S. Patent Specification No. 4,629,473) to use foam in a flexible grinding tool, nevertheless this is a prefabricated foam layer which is laminated between the backing and the grain layer, to give the grain layer flexibility. In contrast, the invention does not intend that the grain layer should have any flexibility.

The process according to the invention is defined in that the mass to be introduced as a finish into-the backing contains a foaming agent. It is not necessary, though advantageous, for foaming to take place at least partially after the introduction into the backing. Conventional application techniques can be used. For example, if the consistency is very low, the backing to be finished can be conveyed through a dipping bath containing the finishing mass, after which the surplus is squeezed off by means of a pair of pressing rollers. With masses of higher viscosity and with masses already partially or completely foamed, the application appropriately takes place by means of a doctor. This applies especially when the surface of the mass is smoothed level with the highest elevations of the fibrous structure of the backing. Smoothing appropriately takes place after the end of foaming, if the aim is to ensure that the layer is level with the fibrous structures. If, on the other hand, it is desirable that the foamed interspace filling should project beyond the height of the fibrous structures on the rear side of the backing, smoothing is appropriately carried out before the end of foaming. Finally, as already mentioned, calendering can be carried out. This applies especially to continuous foam layers on the rear side of the backing.

The advantage of filling interspaces on the grain side is that the grain binder cannot penetrate the backing. Even the cheaper open fabrics and stitch-bonded materials can therefore be used without the danger of embrittlement.

The invention is explained below with reference to the drawing which illustrates advantageous exemplary embodiments. In the drawing.

Figure 1:
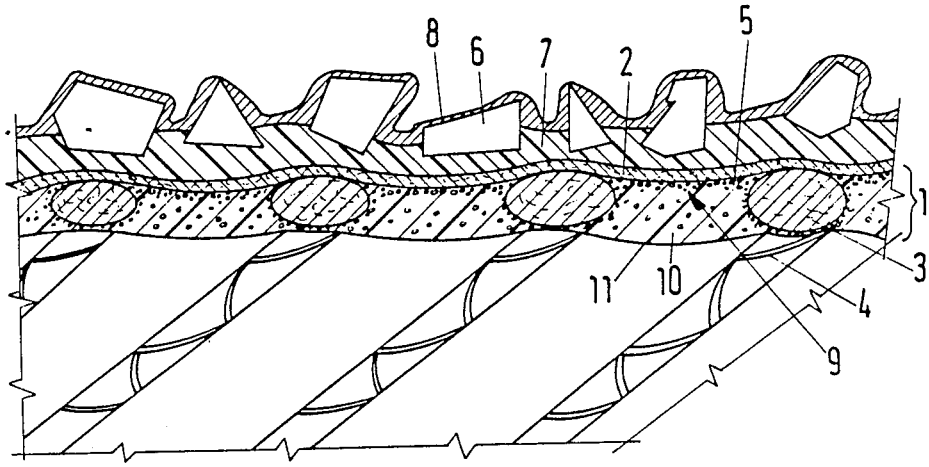
FIG. 1 shows a perspective sectional view of a first embodiment.

The flexible grinding tool according to FIG. 1, which can be a grinding belt, comprises a backing 1, the textile part of which is a stitch-bonded material composed of a nonwoven or fiber strands 2 of a direction parallel to the drawing plane, of threads or fiber strands 3 running parallel to this, and of stitching threads 4, by means of which the fiber strands 3 and the layer 2 are connected to one another. Stitch-bonded fabrics of this type and their use for flexible grinding tools are known. By the fibrous structures mentioned in general above are meant preferably the fibrous structures formed by thread systems of this kind.

On the front side, a grain layer formed by grains 6 is connected to the backing 1 by means of a binder layer 7 and is covered by a subsequent glue layer 8.

Channel-like depressions 9 form on the rear side between the fiber strands 3. The fiber strands 3 and the stitching threads 4 project to a correspondingly greater extent on the rear side. According to the invention, the depressions 8 are filled with a plastic foam 10, the surface 11 of which attains approximately the height of the fiber strands 3 and stitching threads 4 and is even rounded a little above and beyond these. If the foam is sufficiently soft to be compressed by forces exerted at the rear, such as occur when the belt is pressed against a workpiece, such forces are mainly absorbed by the fiber strands 3 or stitching threads 4 protruding in the manner of ribs in the rear surface of the grinding tool. The foam 10 therefore need not have a very high strength and contributes to transmitting the forces occurring transversely relative to the belt plane only in accordance with its rounding and its modulus of elasticity.

The modulus of elasticity to be selected for the foam therefore depends on the forces to be transmitted. It can be very soft if the rear pressing forces are to be transmitted mainly by the fiber strands 3, but a high compressive strength can also be chosen for the foam if it is to contribute considerably to transmitting the compressive forces. The stress exerted on it can be limited by the amount of its rounding according to its compression up to the plane defined by the fiber strands, thus also limiting the forces to be transmitted by it in relation to the fiber strands.

Any foamable and subsequently solidifying substance generating sufficient adhesion with the backing can be used for the foam finish. Preferable substances are synthetic resin, especially phenols, urea and melamine resins and plastic dispersions based on polyacrylate, polyvinylacetate, polyurethane, polyvinylchloride, polyvinylidenechloride, polyethylene, polyvinylether, acrylonitrile-butadiene-styrene copolymer and polyvinylpropionate, and their interpolymers, copolymers or terpolymers, in each case alone or as a combination of any fractions of these polymers. Furthermore, the foam formed by the plastic dispersion can contain surface-active agents, foaming agents, foam stabilizers, dyestuffs, fillers, cross-linking agents, chemical expanding agents and excipients for adjusting the desired pH value. The foaming gas can be introduced mechanically as air, nitrogen, carbon dioxide or the like or can be generated by chemical conversion within the liquid on which the foam is based. Referring to the substance on which the foam is based as flowable is not intended to exclude the use of viscous substances, provided that the foam is generally at least coatable. The density of the foam during application is appropriately between 0.1 and 0.4 $g/cm^3$, preferably between 0.15 and 0.3 $g/cm^3$. The viscosity of the foam is appropriately between 3000 and 10000 mPa.s. The viscosity of the liquid forming the foam is appropriately between 50 and 1500 mPa.s. The application weight of the foam (in the dry state) is appropriately between 10 and 300 $g/m^2$, preferably between 75 and 150 $g/m^2$. The consistency of the rear foam finish in the ready-to-use state is best characterized by the compressibility, in particular by the force required for compression to half the thickness. This force is appropriately between 700 and 2500 kPa, with the preferred steps indicated further above.

For production, the not yet solidified foam is applied to the rear side of the backing and the surplus is scraped off by means of a doctor blade in a relative movement executed in the direction of the fiber strands 3. The foam mass located on the fiber strands 3 and stitching threads 4 is thereby essentially removed, and there remains only the mass 10 located in the interspaces 9. As a result of rheological processes during scraping or continuing expansion, this can subsequently expand a little more and, as at 11, round out a little more. This is not necessary. In other embodiments, in order to protect the foam against forces exerted at the rear, it can also be expedient, in contrast, for the surface 11 to be a little concave, so as to be set back behind the surfaces of the comparatively firm ribs formed by the fiber strands 3 and stitching threads 4.

A compacting of the foam occurs near the interface with the backing as a result of the removal of at least the larger bubbles, this compacting being indicated in the region 5 and contributing to the excellent bonding of the foam to the backing.

Figure 2:
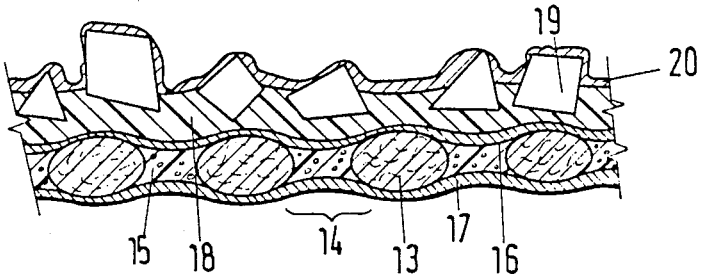
FIG. 2 shows a sectional view of a second embodiment.

The second embodiment accoridng to FIG. 2 shows the cross-section of fiber strands 13 representing a group of parallel threads forming a conventional fabric, of which the threads extending transversely relative to the threads 13 have been omitted for the sake of simplicity. The threads 13 form open interspaces 14 with one another. The threads extending transversely relative to the threads 13 are likewise at a distance from one another. According to the invention, the interspaces 14 are filled with a foam finish 15. To improve the strength of the backing, a solid layer 16, 17 can subsequently be applied on the front side and, if appropriate, also on the rear side. The binder layer 18, the grain 19 and the subsequent glue layer 20 are applied thereafter.

Figure 3:
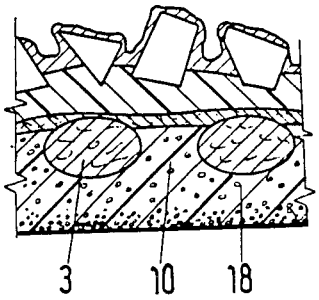
FIG. 3 shows a section view of a third embodiment.

FIG. 3 shows an embodiment which differs from that according to FIG. 1 in that there is a rear foam layer 18 which has a considerable thickness, preferably between 0.2 and 1 mm, more preferably between 0.3 and 0.6 mm. In an example tested in practice, a stitch-bonded fabric with a weight per unit area of 260 $g/m^2$ was first given a basic finish and then provided on the rear side with a foam coating by means of a roller doctor, with a free gap between the roller doctor and backing surface of 0.75 mm. The application quantity was 75 $g/m^2$. After drying between 85 and 100° C., the remaining layer was calendered by means of a steel platen under a linear pressure of 50 daN/cm and at a roller temperature of 170° C. Condensation subsequently occurred at 150° C. The grain side was treated in the conventional way.

In comparison with a conventional grinding belt of the same type, the saving in terms of the application of solids during finishing was 75 $g/m^2$.

The applied foam was composed of a foamed aqueous plastic dispersion with a synthetic-resin content, in particular containing 33.3% by weight of Dicrylan 7326 (Chem. Fabrik Pfersee) Acrylate copolymer self-cross-linking, 50.0% by weight of Dicrylan 7331 (Chem. Fabrik Pfersee) Acrylate copolymer,
4.2% by weight of Knittex CR (Chem. Fabrik Pfersee) Ethylene urea triazine resin,
4.2% by weight of helizarine white AM (BASF) dyestuff,
8.3% by weight of Dicrylan stabilizer 7320 (Chem. Fabrik Pfersee) foam stabilizer.

The foam density was 0.225 g/cm$^3$.

We claim:

1. A flexible abrasive comprising:
a grain layer having a grain binder which carries abrasive grain;
a fibrous backing layer defining a front surface bearing on the grain layer and a rear surface facing away from the grain layer, the fibrous material of the backing layer having surface depressions on at least one of the front or rear surfaces; and
a finish forming part of the backing layer and at least partially filling the depressions on said at least one surface, the finish material being a foam solidified from a flowable state, whereby said surface is rendered smooth.

2. A flexible abrasive comprising:
a grain layer having a grain binder which carries abrasive grain;
a fibrous backing layer defining a front surface bearing on the grain layer and a rear surface facing away from the grain layer, the fibrous material of the backing layer front surface having large depressions including interspaces between the fibers; and
a finish material forming part of the backing layer and at least partially filling the depressions on the front surface, the finish material being solidified from a flowable foam, whereby the front surface is rendered smooth.

3. The abrasive of claim 2, wherein
the fibers associated with the backing layer front surface protrude relative to the depressions, the protruding portions of the fibers defining a front plane of the backing, and
the depressions on the front surface are filled with solidified foamed resin finish material up to but not substantially beyond the front plane,
whereby the protruding portions and the finish material form a generally smooth front surface.

4. A flexible abrasive comprising:
a grain layer having a grain binder which carries abrasive grain;
a fibrous backing layer defining a front surface bearing on the grain layer and a rear surface facing away from the grain layer, the fibrous material of the backing layer rear surface having depressions including interspaces between the fibers; and
a finish material forming part of the backing layer and at least partially filling the depressions on the rear surface, the finish material being solidified from a flowable foam, whereby the rear surface is rendered smooth.

5. The flexible abrasive as claimed in claim 1, wherein the density of the foamed finish is greater at the contact of the finish with the fibers on said surface of the backing than at a distance from such contact.

6. The flexible abrasive as claimed in claim 1, wherein the backing has spaced apart fiber strands between which are located interspaces which define the depressions and which are substantially filled by the foamed finish.

7. The flexible abrasive as claimed in claim 6, wherein the foamed finish is arranged on the rear side of the backing substantially only between the fiber strands without any appreciable finish thickness on the fiber strands, and wherein the height of the foamed finish between the fiber strands in the non-loaded operating state is greater than the height of the fiber strands.

8. The flexible abrasive as claimed in claim 7, wherein the foamed finish is compressible under the loaded operating state to at least the height of the fiber strands.

9. The flexible abrasive as claimed in claim 1, wherein the foamed finish forms a layer covering the backing substantially completely.

10. The flexible abrasive as claimed in claim 9, wherein the pressure necessary for compressing the foam finish to half its thickness is at least 700 kPa.

11. The flexible abrasive as claimed in claim 1, wherein the foamed finish is located on the front side of the backing and is essentially incompressible under the grinding pressure.

12. The flexible abrasive as claimed in claim 1, wherein the foamed finish forms a smooth surface.

13. The flexible abrasive as claimed in claim 12, wherein the finish is on the rear surface and the density of the foamed finish is greater near its free surface facing away from the grain layer.

14. The flexible abrasive as claimed in claim 11, wherein the density of the foamed finish is is on average more than approximately 0.5 g/cm$^3$.

15. The flexible abrasive as claimed in claim 14, wherein the density of the foamed finish is on average less than approximately 0.9 g/cm$^3$.

16. The flexible abrasive as claimed in claim 11, wherein the foamed finish on the surface of the backing is covered by another layer of material having a higher strength than the finish.

17. A process for filling and finishing a flexible abrasive having a grain layer and a fibrous backing layer which has front and rear surfaces defining fiber interspaces, comprising the steps of applying a resin containing a foaming agent to at least one of the front or rear surfaces of the backing layer to at least partially fill the fiber interspaces, and hardening the resin foaming agent to form said finish.

18. The process as claimed in claim 17, wherein the foaming takes place at least partially after the introduction of the mass into the backing.

19. The process as claimed in claim 7, wherein the applied mass defines an exposed surface and the exposed surface of the mass is smoothed level with the highest elevations of the fibrous structure of the backing.

20. The process as claimed in claim 19, wherein the smoothing takes place after the end of foaming.

21. The process as claimed in claim 19, wherein the smoothing takes place before the end of foaming.

22. The process as claimed in claim 17, wherein foam layer applied to the rear surface is calendered after foaming.

* * * * *

UNITED STATES PATENT AND TRADEMARK OFFICE

CERTIFICATE OF CORRECTION

PATENT NO. : 4,964,884

DATED : October 23, 1990

INVENTOR(S) : Gunter Jurissen et al

It is certified that error appears in the above-identified patent and that said Letters Patent is hereby corrected as shown below:

On the title page:

In item [73], which states the name and address of the Assignee, please change "Inorddeutsche Industrie" to --Norddeutsche Schleifmittel-Industrie--.

Please amend claims 14-16, 19 and 22 as follows:

Claim 14, line 1, change "11" to --1--;
line 2, delete "is on average";

Claim 15, line 2, delete "on average";

Claim 16, line 1, change "11" to --1--;

Claim 19, line 1, change "7" to --17--;

Claim 22, line 1, after "wherein" insert --a--.

Signed and Sealed this

Twenty-eighth Day of July, 1992

*Attest:*

DOUGLAS B. COMER

*Attesting Officer*

*Acting Commissioner of Patents and Trademarks*